US008598994B2

(12) United States Patent
Lin et al.

(10) Patent No.: US 8,598,994 B2
(45) Date of Patent: Dec. 3, 2013

(54) METHOD FOR CONTROLLING APPLIANCES BY SWING MOTION

(75) Inventors: Hwa-Chuan Lin, Yunlin County (TW); Jeng-Haur Horng, Yunlin County (TW); Chia-Kai Chang, Yunlin County (TW); Yu-Heng Hsieh, Yunlin County (TW); Ya-Hsin Hong, Yunlin County (TW)

(73) Assignee: National Formosa University, Yunlin County (TW)

( * ) Notice: Subject to any disclaimer, the term of this patent is extended or adjusted under 35 U.S.C. 154(b) by 300 days.

(21) Appl. No.: 12/969,871

(22) Filed: Dec. 16, 2010

(65) Prior Publication Data

US 2011/0221581 A1 Sep. 15, 2011

(30) Foreign Application Priority Data

Mar. 11, 2010 (TW) ..... 99107094 A

(51) Int. Cl.
*G08C 19/12* (2006.01)

(52) U.S. Cl.
USPC ..... 340/13.24; 345/156; 345/158

(58) Field of Classification Search
USPC ..... 340/13.24; 345/158, 156
See application file for complete search history.

(56) References Cited

U.S. PATENT DOCUMENTS

| | | | | |
|---|---|---|---|---|
| 5,554,980 | A * | 9/1996 | Hashimoto et al. | 345/158 |
| 2007/0236381 | A1* | 10/2007 | Ouchi et al. | 341/176 |
| 2008/0009332 | A1* | 1/2008 | Kake | 463/7 |
| 2010/0062833 | A1* | 3/2010 | Mattice et al. | 463/24 |
| 2010/0130132 | A1* | 5/2010 | Lee et al. | 455/41.3 |
| 2010/0141574 | A1* | 6/2010 | Jung et al. | 345/156 |
| 2010/0188334 | A1* | 7/2010 | Yamamoto et al. | 345/158 |
| 2010/0306798 | A1* | 12/2010 | Ahn et al. | 725/38 |
| 2011/0121892 | A1* | 5/2011 | Bowdle | 327/544 |

* cited by examiner

*Primary Examiner* — George Bugg
*Assistant Examiner* — Naomi Small
(74) *Attorney, Agent, or Firm* — Rosenberg, Klein & Lee

(57) ABSTRACT

A method for controlling appliances includes a wearing step, a swinging step and a controlling step. The control device is attached to a movable part of a user's body and the user swings the movable part to generate and send a control signal to the appliance so as to activate and control the appliance. The method is also helpful for rehabilitation to disable people.

1 Claim, 6 Drawing Sheets

METHOD FOR CONTROLLING APPLIANCES BY SWING MOTION

FIELD OF THE INVENTION

The present invention relates to a method for controlling appliances, and more particularly, to a method for swinging a control device attached on a movable part of user to control appliances.

BACKGROUND OF THE INVENTION

A conventional method for controlling appliances such as television, air conditioner and DVD player is completed by operation of a remote controller which generally is portable and includes multiple function key pads. The user holds the controller and presses the key pads by fingers. However, these actions are difficult for those users whose hands or fingers are injured. Because the conventional controllers cannot be worn to a part of the user's body so that the hand injured people cannot use them.

The present invention intends to provide a method for controlling appliances by swinging the control device attached on the user's movable part to generate control signals which are received by the appliances and activate the appliances.

SUMMARY OF THE INVENTION

The present invention relates to a method for controlling appliances and comprises a wearing step, a swinging step and a controlling step. The control device is attached to a movable part of a user's body and swung with the movable part to generate and send a control signal to the appliance so as to activate and control the appliance. The method is also helpful for rehabilitation to disable people.

The primary object of the present invention is to provide a method for controlling the appliances, especially designed for the people who are injured at hands or fingers, by attaching a control device on a movable part of the user's body. The user swings the movable part of his/her body to generate and send a control signal to the appliance so as to activate and control the appliance.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
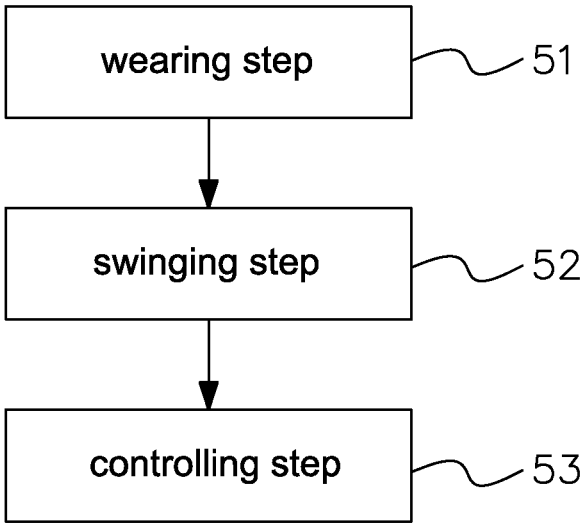
FIG. 1 shows the steps of the method of the present invention.
Figure 2:
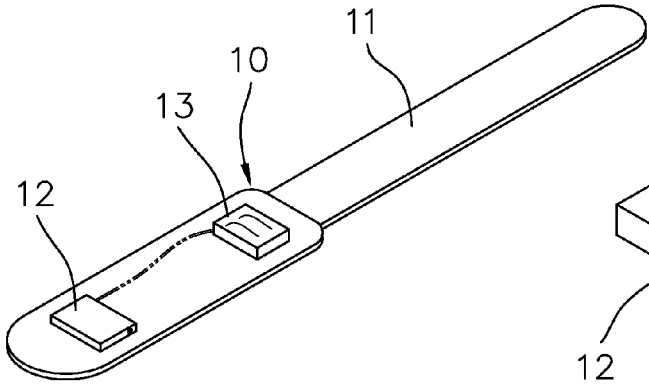
FIG. 2 shows the control device used in the method of the present invention.
Figure 3:
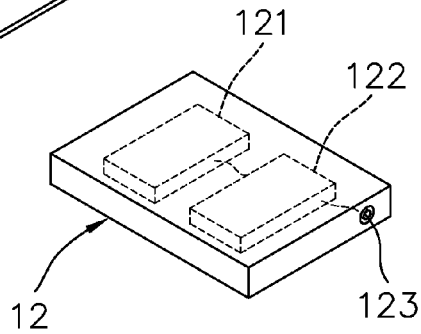
FIG. 3 shows the control portion of the control device used in the method of the present invention.

Referring to FIGS. 1 to 3, the method of the present invention comprises the steps of wearing step 51, swinging step 52, and controlling step 53.

Figure 4:
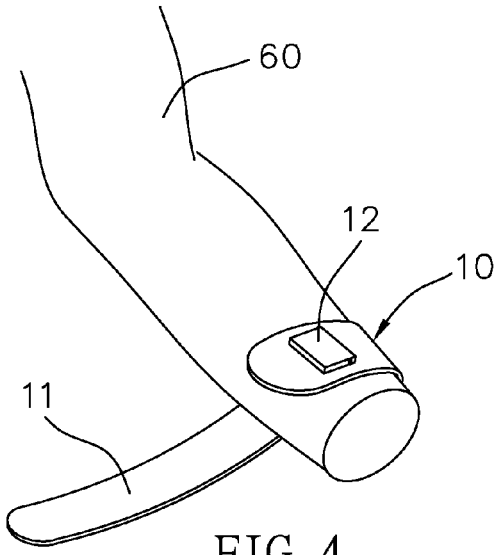
FIG. 4 shows that the control device used in the method of the present invention is to be attached to the user's arm.
Figure 5:
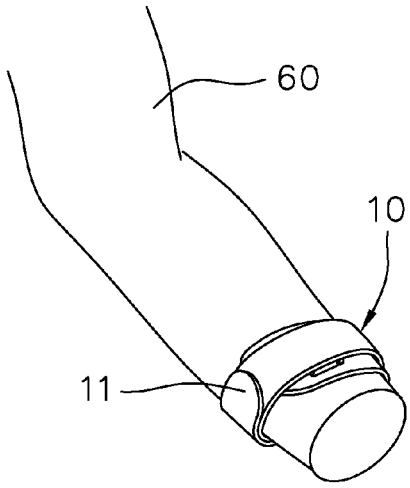
FIG. 5 shows that the control device used in the method of the present invention is attached to the user's arm.
Figure 6:
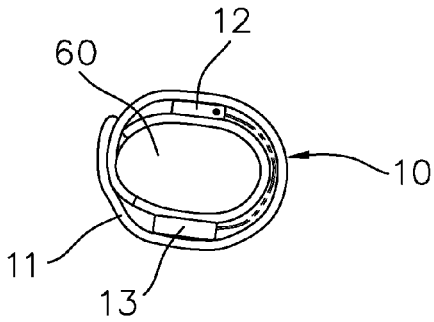
FIG. 6 shows a view of the control device attached to the user's arm.

About the wearing step 51, the user wears a control device 10 to a movable part 60 of a user's body, such as the arm or the palm, and the control device 10 has a wearing portion 11, a control portion 12 and a power supply 13. The control portion 12 has a three-axis acceleration detector 121, a signal generating portion 122 and an infra-red beam emitting portion 123. The wearing portion 11 attaches the control device 10 to the movable part 60 of the user's body as shown in FIGS. 4 to 6 and the three-axis acceleration detector 121 detects the action of the control device 10 and generates a voltage change. The control signal generating portion 122 generates a control signal 101 based on the voltage change, and the control signal 101 is emitted by the infra-red beam emitting portion 123. The power supply 13 provides electric power to the control portion 12.

About the swinging step 52, the control device 10 on the movable part 60 of the user's body is positioned at a first position and being swung to a second position and then moving the control device 10 on the movable part 60 of the user's body back to the first position to complete a full swinging action.

Figure 7:
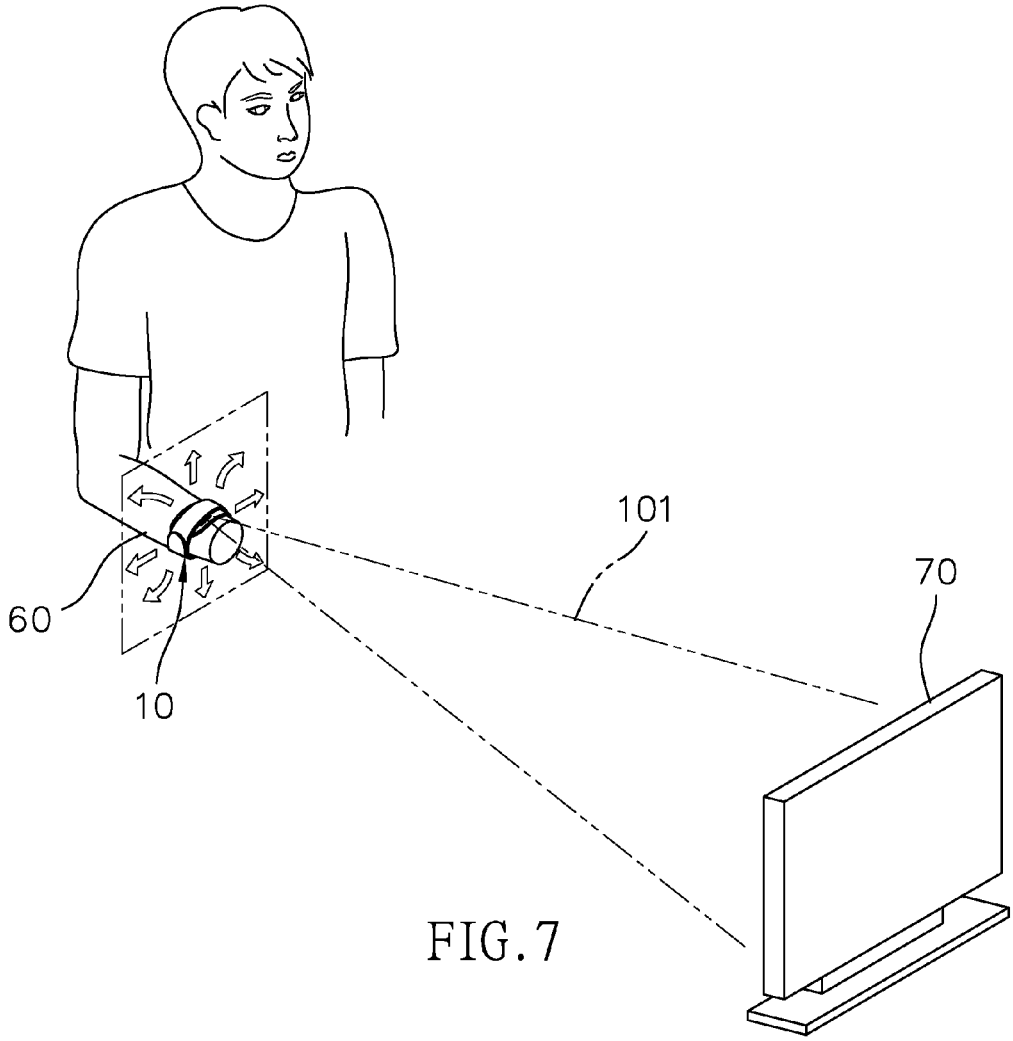
FIG. 7 shows the operation of the control device by swinging the movable part of the user's body.

With regard to the controlling step 53, the control device 10 sends the control signals 101 to activate appliances 70 as shown in FIG. 7.

The appliances 70 can be televisions, air conditioners, DVD players and audio equipment. The appliances 70 are equipped such that the infra-red information and formats can be received. The control signals 101 based on different actions of swinging of the control device 10 are able to control the appliances 70.

Figure 8:
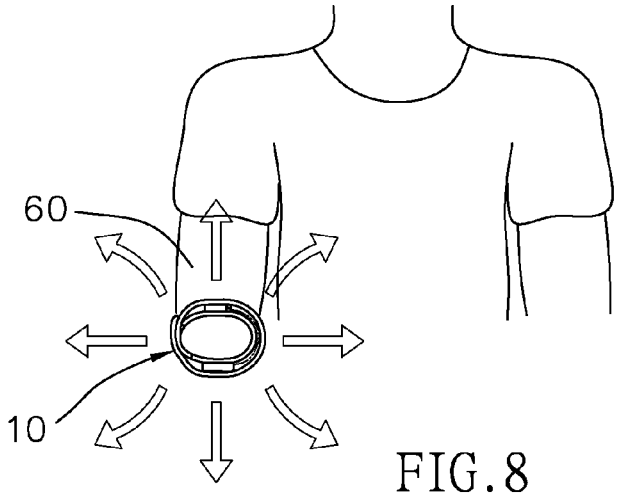
FIG. 8 is an end illustration view to show the swinging actions in FIG. 7.

As shown in FIGS. 7, 8 and the Table 1 below, the appliance 70 is a television and the control device 10 is attached to the user's arm and can perform eight different actions so as to generate different voltages. The signal generating portion 122 generates eight different control signals 101 based on the eight different actions to control the functions of the television 70. The first position is a position wherein the control device 10 is parallel to ground. For example, when the control device 10 is vertically moved up to reach the second position, the command is to increase the audio volume, and when the arm moves back to the first position, the infra red beam emitting portion 123 emits a control signal 101 to the television to increase the audio volume. It is noted that the actions can be set by the user.

TABLE 1

| Control signal | Action | Voltage change |
|---|---|---|
| Preparation or complete the action | Horizontal to the ground | X-axis: 1.4~1.6 v<br>Y-axis: 1.4~1.6 v |

TABLE 1-continued

| Control signal | Action | Voltage change |
|---|---|---|
| | | Z-axis: >1.8 v |
| Channel moved downward by 1 channel | Horizontally moved to the left | X-axis: <1.4~1.6 v<br>Y-axis: 1.4~1.6 v<br>Z-axis: <1.8 v |
| Channel moved up by 1 channel | Horizontally moved to the right | X-axis >1.4 v<br>Y-axis: >1.4~1.6 v<br>Z-axis: <1.8 v |
| Audio increased | Backward | X-axis: 1.4~1.6 v<br>Y-axis: <1.4 v<br>Z-axis: <1.8 v |
| Audio reduced | Tilt forward | X-axis: 1.4~1.6 v<br>Y-axis: >1.6 v<br>Z-axis: <1.8 v |
| Favorite channels | Tilt left-front | X-axis: <1.4 v<br>Y-axis: >1.6 v<br>Z-axis: <1.8 v |
| Channel moved up by 10 channels | Tilt right-front | X-axis: >1.6 v<br>Y-axis: >1.6 v<br>Z-axis: <1.8 v |
| Fast setting | Tilt right back | X-axis: >1.6 v<br>Y-axis: >1.4 v<br>Z-axis: <1.8 v |
| Television ON/OFF | Tilt left back | X-axis: <1.4 v<br>Y-axis: <1.4 v<br>Z-axis: <1.8 v |

Figure 9:
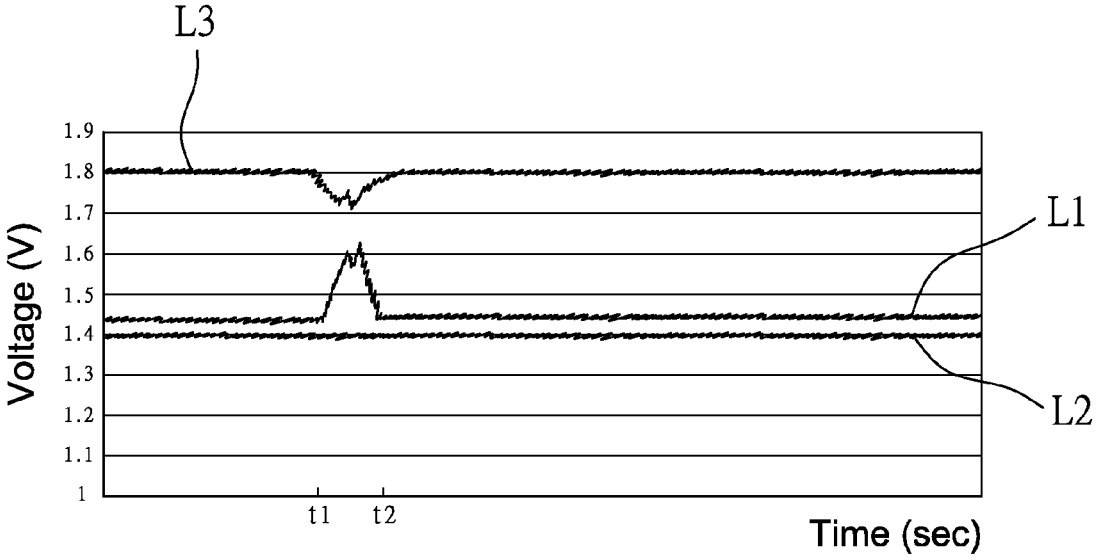
FIG. 9 shows the voltage change of the control device used in the method of the present invention.

Referring to FIG. 9, when the control device 10 is moved horizontally from the first position to the right and reaches the second position, the first line L1 shows the voltage change of the X-axis, the first line L2 shows the voltage change of the Y-axis, and the third line L3 shows the voltage change of the Z-axis. The control device 10 is moved at the first time point t1 to the second time point t2 (taking about 0.5 second). The control device 10 is moved horizontally from the first position to the right and reaches the second position to generate the voltage change wherein the voltage of the X-axis is over 1.6 V and voltage of the Z-axis is less than 1.8 V.

Figure 10:
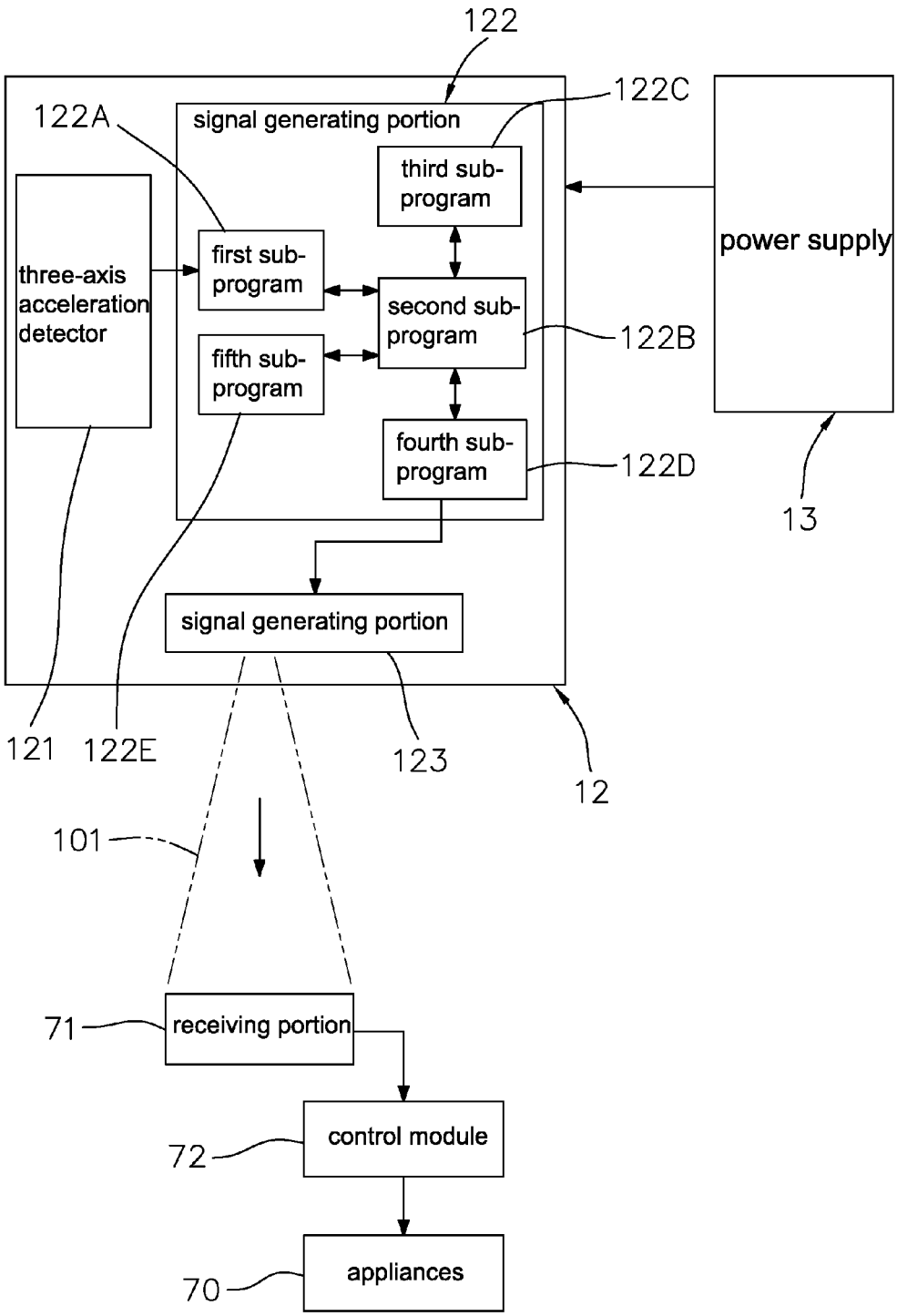
FIG. 10 shows the diagram of the control device used in the method of the present invention.

FIG. 10 shows the diagram of the control portion 12 wherein the signal generating portion 122 includes a first sub-program 122A which detects the voltage change generated from the three-axis acceleration detector 121 and judges positions of the control device 10, a second sub-program 122B which generates the control signals 101 based on the positions judged by the first sub-program 122A, a third sub-program 122C which reads favorite channels, a fourth sub-program 122D which transfers the control signals 101 from the second sub-program 122B to the infra-red beam emitting portion 123, and a fifth sub-program 122E which is a energy-saving sub-program and is activated when the control device 10 is stationary and the three-axis acceleration detector 121 does not generate voltage change.

The appliance 70 includes a receiving portion 71 for receiving the control signals 101, and a control module 72 as shown in FIG. 10. The control module 72 controls the appliance 70 according to the received control signal 101.

Figure 11A:
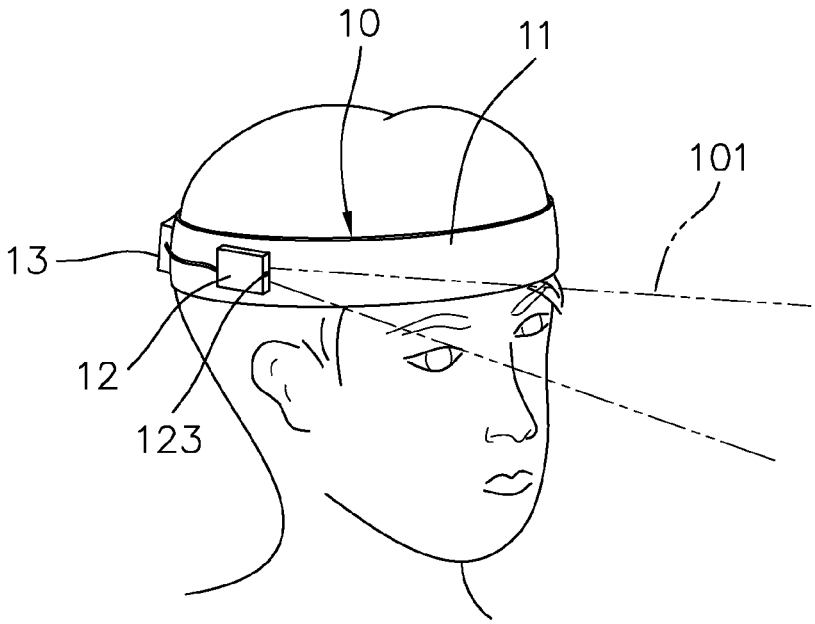
FIG. 11A shows that the second embodiment of the control device used in the method of the present invention is attached to the user's head.
Figure 11B:
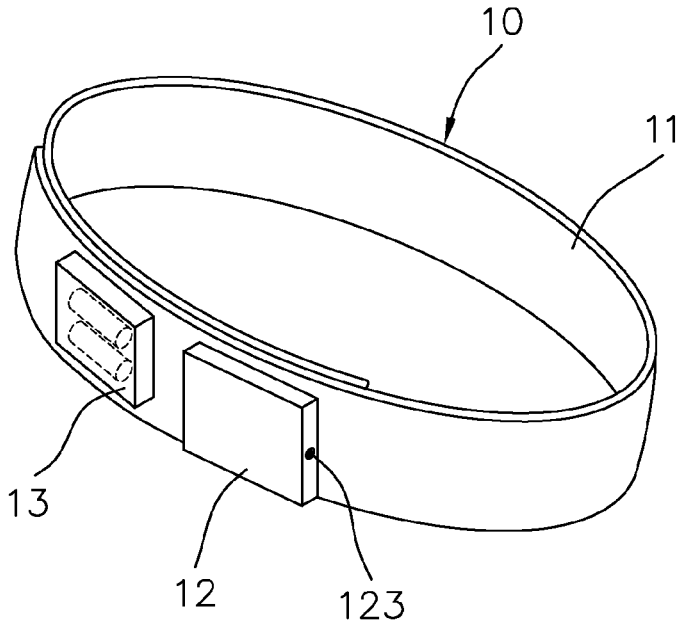
FIG. 11B shows the second embodiment of the control device used in the method of the present invention.

The present invention provides a control device 10 that is attached to the aim or palm of the user who can move his/her arm or palm to generate different control signals 101. The control device 10 can also be worn on the user's head and generate desired control signals 101 by shaking the head as shown in FIGS. 11A and 11B.

Finally, the invention is suitable for the user who has no palm or fingers (or the like) and who wants to control electric appliances. In addition, this invention also can be used as an auxiliary rehabilitation device when the user wears it on a predetermined portion with certain swinging exercise.

While we have shown and described the embodiment in accordance with the present invention, it should be clear to those skilled in the art that further embodiments may be made without departing from the scope of the present invention.

What is claimed is:

1. A method for controlling appliances, comprising:

a wearing step:

wearing a control device to a movable part of a user's body and said control device having a wearing portion, a control portion and a power supply, said control portion having a three-axis acceleration detector, a signal generating portion and an infra-red beam emitting portion, said wearing portion attaching the control device to the movable part of the user's body and said three-axis acceleration detector detecting the action of the control device and generating a voltage change, said control signal generating portion generating a control signal based on the voltage change, said control signal emitted by the infra-red beam emitting portion, said power supply providing electric power to the control portion;

a swinging step:

said control device on the movable part of the user's body being positioned at a base position and being displaced to one of a plurality of positions before being displaced back to the base position to define said voltage change; and a controlling step:

said control device sending the control signals to activate appliances;

wherein said base position represents a starting position and an ending position of said swinging step and the control device is horizontally displaced leftwards to define a first of the plurality of positions, displaced rightwards to define a second of the plurality of positions, displaced vertically upwards to define a third of the plurality of positions, displaced downwards to define a fourth of the plurality of positions, displaced left-front to define a fifth of the plurality of positions, displaced right-front to define a sixth of the plurality of positions, displaced left-back to define a seventh of the plurality of positions, and displaced right-front to define an eighth of the plurality of positions;

wherein said signal generating portion includes a first sub-program that detects the voltage change generated from the three-axis acceleration detector and determines positions of the control device, a second sub-program that generates the control signals based on the positions determined by the first sub-program, a third sub-program that reads favorite channels, a fourth sub-program that transfers the control signals from the second sub-program to the infra-red beam emitting portion; and wherein said signal generating portion includes a fifth sub-program that is an energy-saving sub-program and is activated when the control device is stationary and the three-axis acceleration detector does not generate voltage change.

* * * * *